United States Patent [19]

Spademan

[11] 4,322,089

[45] Mar. 30, 1982

[54] SKI BRAKE

[76] Inventor: Richard G. Spademan, Box 6410, Incline Village, Nev. 89450

[21] Appl. No.: 73,997

[22] Filed: Sep. 10, 1979

[51] Int. Cl.[3] ..... A63C 7/10

[52] U.S. Cl. ..... 280/605; 74/527; 403/111

[58] Field of Search ..... 280/605, 12 AB, 604; 108/131, 133; 74/527; 403/83, 111; 248/439

[56] References Cited

U.S. PATENT DOCUMENTS

| | | | |
|---|---|---|---|
| 1,300,861 | 4/1919 | Otte | 248/439 X |
| 1,623,100 | 4/1927 | Dolah | 248/439 X |
| 2,858,140 | 10/1958 | Stamp | 280/639 |
| 4,066,275 | 1/1978 | Martin | 280/605 |
| 4,108,465 | 8/1978 | Schmidt et al. | 280/605 |

FOREIGN PATENT DOCUMENTS

| | | | |
|---|---|---|---|
| 2523012 | 12/1976 | Fed. Rep. of Germany | 280/605 |

*Primary Examiner*—Joseph F. Peters, Jr.
*Assistant Examiner*—Michael Mar
*Attorney, Agent, or Firm*—Townsend and Townsend

[57] ABSTRACT

A ski brake (1) is provided having a pair of movable arm members (15,16). Each of the arm members has a braking surface (18). A pair of spring members (22,23) provide a moving force for moving the arm members (15,16) from an inoperative position to an operative position. A holding member (20) connected to the arm members (15,16) is provided for holding the arm members (15,16) in their inoperative position against the force of the spring members (22,23). A recess (9) is provided for engaging the holding member (20) when the holding member (20) is in its operative position for restraining the arm members (15,16) against a force of ice and snow impacting the braking surface (18) which is greater than the force required to be applied to said holding means (20) to move the arm members (15,16) from their inoperative to their operative position.

7 Claims, 4 Drawing Figures

SKI BRAKE

BACKGROUND OF THE INVENTION

The present invention relates to snow skiing apparatus in general and in particular to a ski brake for preventing a runaway ski upon separation of the ski from a ski boot.

Ski brakes have been adopted and used in recent years for preventing a runaway ski upon separation of a ski from a ski boot. Prior to the use of ski brakes, it was and frequently still is the practice to prevent a runaway ski by tying the ski to a skier's foot as by a tether such as a strap or the like. In use, in the event of a separation of a ski from a ski boot, as during a fall, the strap or other tether prevents the ski from becoming loose and running away in an uncontrolled manner. Runaways, it will be appreciated, can cause serious and even fatal injuries to skiers downhill from the falling skier.

The use of a strap or the like for tying a ski to a skier's foot, while suitable for preventing loss of a ski during a fall and injury to others downhill from the falling skier, can still result in injuries to the falling skier. Such injuries are caused by the ski swinging uncontrollably on the end of the tether and striking the skier.

To avoid injury to both the falling skier as well as to skiers downhill from the falling skier, an automatic ski brake may be employed instead of a tether.

While a variety of braking means are prior known, possibly the most popular type of ski brake heretofore proposed comprises a pair of arm members which extend along each side of a ski. During a fall, when a separation of a ski and a ski boot occurs, the arm members which carry braking surfaces pivot or otherwise move downwardly to an operative position below the bottom surface of the ski for engaging ice and snow. This prevents sliding of the ski. During normal skiing the arm members and braking surfaces are moved to a non-interfering or inoperative position and are held there against a spring force or the like by the pressure of the ski boot on a holding apparatus coupled to the braking arm members. A disclosure of the type of ski brake described hereinabove, with certain improvements having to do with the positioning of the braking arm members when they are moved to their inoperative position is disclosed in U.S. Pat. No. 3,989,271, issued to Riedel, Nov. 2, 1976.

The principal disadvantages of prior known ski brakes lie in the manner in which they are moved from an inoperative position to an operative position, the manner in which the arms are held in their operative position and the manner in which they are held in their inoperative position. Generally, a spring member or other force member is used to move the braking arm members to their operative position upon separation of a ski from a ski boot. With the braking arm members in their operative position, the spring member is substantially fully extended and necessarily the spring force for holding the braking members against the force of snow and ice impacting thereagainst is minimal or at least substantially less than the force typically required for holding the braking arm members in their inoperative position. Because considerable force is required to hold the braking arm members in their operative position against the force of snow and ice impacting thereagainst, the spring members heretofore used have been relatively heavy and the magnitude of the force necessary to hold the braking arm members in their inoperative position relatively large. This has resulted in a tendency for the holding apparatus used for holding the braking arm members in their inoperative position to push the ski boot upwardly in the binding during the time that the ski boot is holding the ski braking members in their inoperative position. This tendency to elevate the boot in the binding is found to change the release characteristics of the binding in an undesirable manner. For this reason, it is desirable to have a ski brake in which the holding forces for holding the ski brake arm members in their inoperative position are substantially less than those necessary for opposing the forces of ice and snow impacting thereagainst during braking of the ski after separation of the ski and the ski boot.

SUMMARY OF THE INVENTION

In view of the foregoing, a principal object of the present invention is an improved ski brake with means for preventing undesirable elevating of a ski boot in a ski binding which changes the release characteristics of the binding.

Another object of the present invention in accordance with the above object, is a ski brake with means requiring a greater force to be applied against the braking surfaces of the ski brake which tends to move the ski brake from its operative position to its inoperative position than is required for moving the ski brake from its inoperative to its operative position.

Another object of the present invention, in accordance with the above objects, is a ski brake having a movable arm member on which there is provided a braking surface, a holding means for holding the arm member in its inoperative position and a recess for receiving the holding means when the arm member is moved from its inoperative position to its operative position, said recess having an inclined wall surface for deforming the holding means as the arm member is moved from its operative position to its inoperative position and wherein said deformation of said holding means requires a force applied to the braking surfaces which is greater than the force required to be applied to the holding means to move the holding means from its inoperative to its operative position.

BRIEF DESCRIPTION OF THE DRAWING

The above and other objects, features and advantages of the present invention will become apparent from the following detailed description of the accompanying drawing in which.

DETAILED DESCRIPTION OF THE DRAWING

Figure 1:
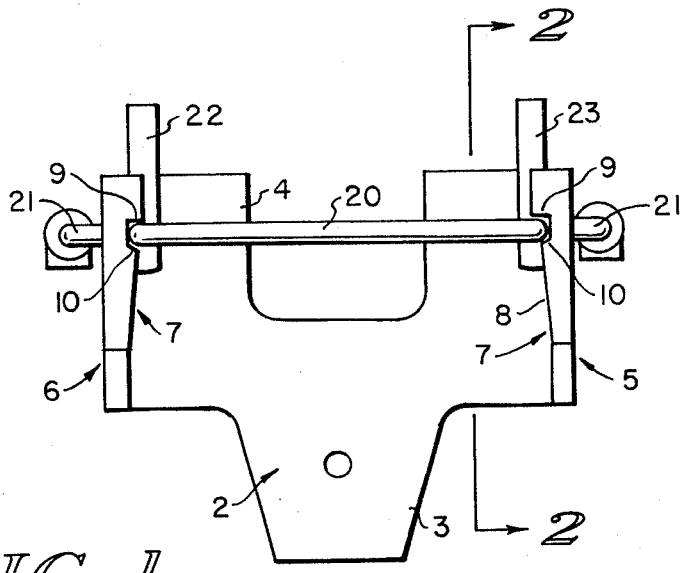
FIG. 1 is a plan view of a ski brake according to the present invention.
Figure 2:
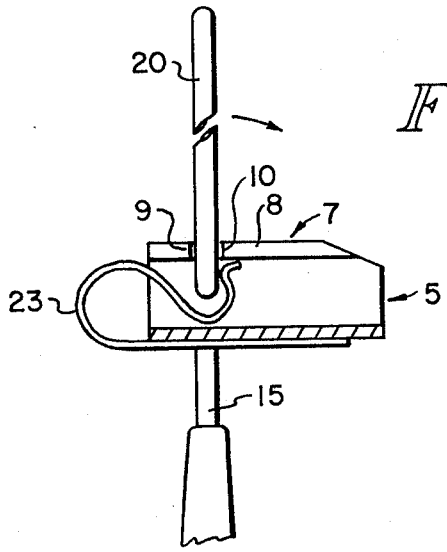
FIG. 2 is a partial cross-sectional view taken along lines 2—2 of FIG. 1.
Figure 3:
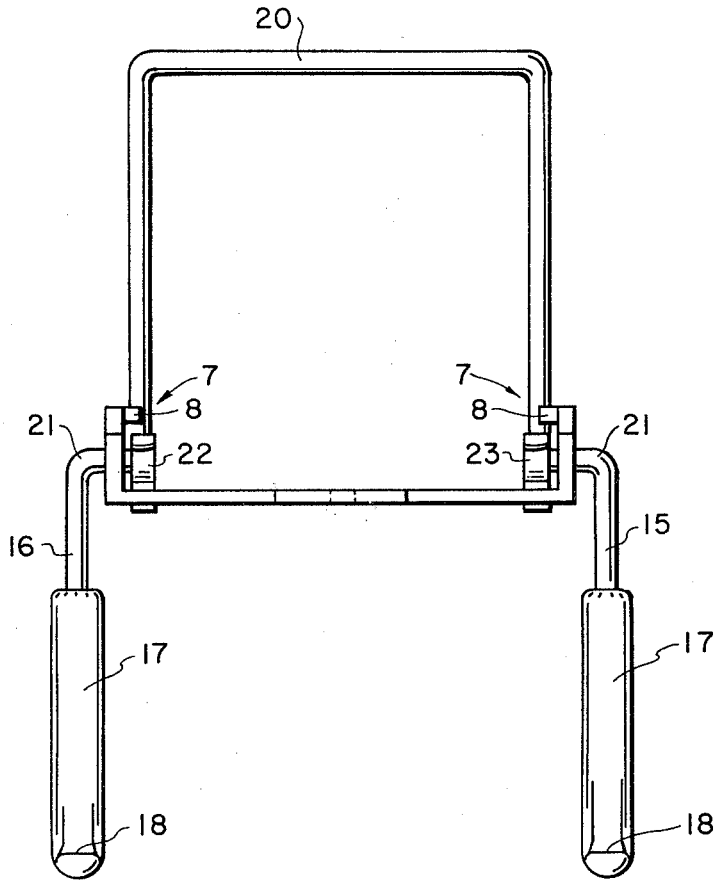
FIG. 3 is a front elevation view of FIG. 1.
Figure 4:
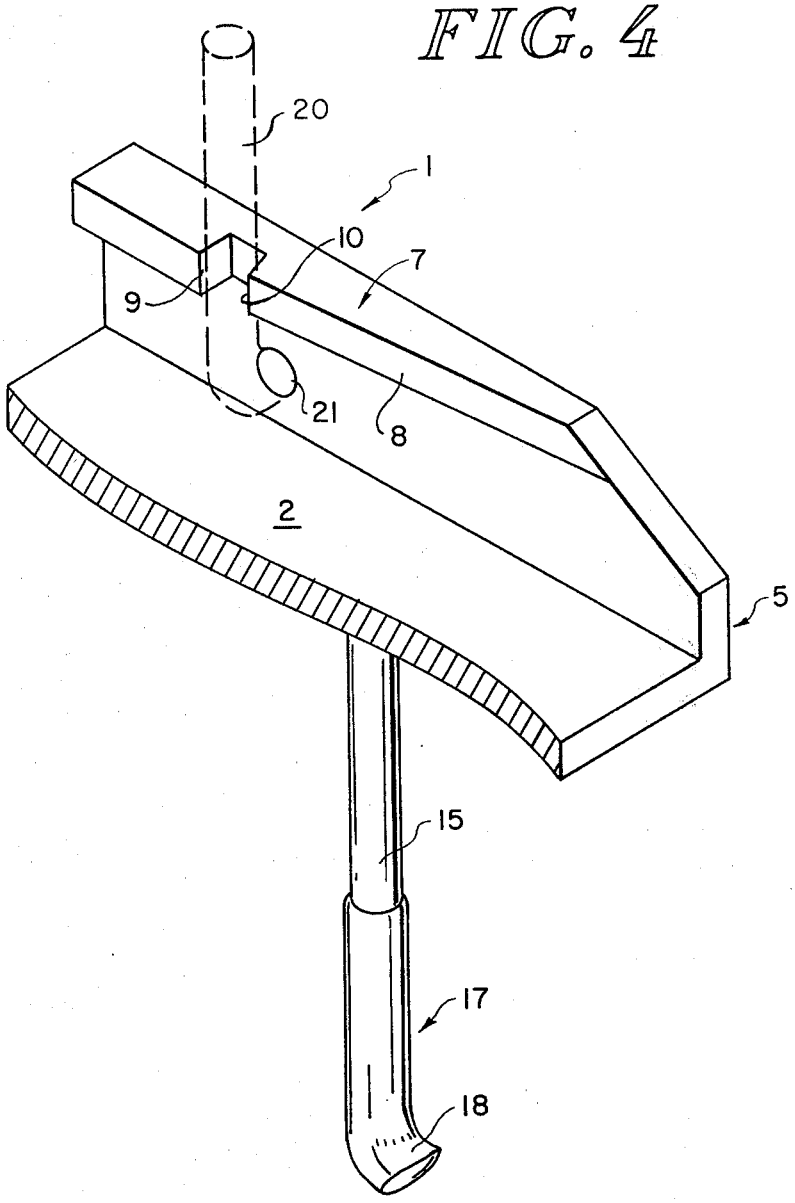
FIG. 4 is a partial front perspective view of the apparatus of FIG. 1.

Referring to the figures, there is provided, in accordance with the present invention, a ski brake designated generally as 1. In the ski brake 1 there is provided a base plate 2 having a forwardly extending projection 3 and a cutout portion 4 in the rear thereof. The extended portion 3 and cut-out portion 4 are provided to accommodate the mounting of the ski brake 1 to a ski in conjunction with a particular type of ski binding such as the type of binding disclosed in U.S. Pat. No. 3,606,370, issued to applicant on 20 Sept. 1971. For other bindings, other cut-outs, projections, screw holes and the like may be provided.

On the lateral edges of the base plate 2 there is provided a pair of side wall members 5 and 6. At the top of each of the side wall members 5 and 6 there is provided an inwardly directed wedge-shaped abutment 7. The abutment 7 is provided with an inclined surface 8. The inclined surface 8 is inclined inwardly in a direction toward the rear of the base plate 2. Intermediate the forward and rear ends of the abutment 7, there is provided a recess 9. The recess 9 is provided with a forward inclined wall surface 10. The inclined surface 10 is inclined toward the front of the brake 1 in a direction toward the center of the brake 1.

Extending from holes provided therefor in the side walls 5 and 6, there is provided a pair of braking arm members 15 and 16. On the lower ends of each of the arm members 15 and 16 there is provided a member 17 having a braking surface 18. Extending from the upper ends of the arms 15 and 16, there is provided a U-shaped extended portion forming a deformable holding member 20 for holding the braking arm members 15 and 16 in their inoperative position as will be described below. Interconnecting the holding member 20 and the arms 15 and 16 there is provided a horizontally extending pivot portion 21. The pivot portion 21 extends through the holes provided in the side wall members 5 and 6. In contact with the lower extremities of the member 20 there is provided a pair of spring members 22 and 23. The spring members 22 and 23 provide a spring force for moving the arm members 15 and 16 from their inoperative position to an operative position, as shown in the figures.

In use, a skier, when stepping into the ski binding to which the ski brake 1 is fitted, engages the member 20. As the skier presses against the member 20, the member 20 is moved forwardly and downwrdly against the force of the spring members 22 and 23. As the member 20 is moved forwardly and downwardly, the lower extremities thereof engage the inclined wall surface 10 of the recess 9. With further pressure, the member 20 is pivoted toward a plane substantially parallel to the surface of the ski while being deformed inwardly by the wall 10 until it is guided out of the recess 9 and along the inclined surface 8 of the abutment 7. At the same time that the member 20 is pivoted forwardly and downwardly to a plane substantially parallel to the upper surface of the ski, the arm members 15 and 16, extending from the lower extremities thereof, are pivoted upwardly and rearwardly to an inoperative position in a plane substantially parallel to the upper surface of the ski along the sides of the ski. So long as the arm members 15 and 16 are held by the ski boot in their inoperative position, they do not interfere with or otherwise impair normal skiing.

During a fall, when a ski boot separates from a ski, and no longer bears down on the member 20, the spring members 22 and 23 move the member 20 and the arms 15 and 16 from their inoperative position to their operative position. As the member 20 and the arms 15 and 16 are moved into their operative position, the member 20 engages the recess 9. With the member 20 engaged in the recess 9, considerable force of ice and snow impacting the braking surface 18 is required to be applied against the braking surface 18 to move the arm 20 out of the recess 9. In each case the angle of the inclined surface 10 and the strength of the springs 22 and 23 is chosen such that the force of the ice and snow against the braking surface 18 which is necessary to remove the arm 20 from the recess 9 exceeds the force required to move the arm members 15 and 16 from their inoperative to their operative position.

While an embodiment and suggested alternative features are described, it is understood that various other modifications and changes may be made without departing from the spirit and scope of the present invention. For example, various component parts of the apparatus described may be made from metal or high-strength plastic. Also, a single instead of plural braking arms may be employed or their location changed. Accordingly it is intended that the scope of the present invention not be limited to the embodiments described but be determined by reference to the claims hereinafter appended and their equivalents.

What is claimed is:

1. A ski brake comprising:

means for forming a movable arm member movable between an operative position and an inoperative position;

means providing a moving force for moving said arm member from its inoperative position to its operative position;

means responsive to an applied force for holding said arm member in its inoperative position against said moving force, said holding means including a resilient material;

a braking surface located on said arm member for engaging snow when said arm member is in its operative position; and means separate from said moving force providing means for restraining said arm member in its operative position against a force tending to move said arm member from its operative position to its inoperative position, said restraining means including means for forming a recess into which said holding means moves when said arm member is moved to its operative position by said moving force, said means forming said recess including an inclined wall surface for guiding said holding means into said recess when said arm member is moved from its inoperative position to its operative position, said inclined wall surface applying an increasing bending stress to said holding means as said arm member is moved from its inoperative position to its operative position.

2. The improvement according to claim 1 wherein said moving force providing means comprises a spring member.

3. The improvement according to claim 1 wherein said arm member forming means comprises a pair of arm members which, when in said operative position extend downwardly from said ski brake and said holding means comprises a U-shaped member interconnecting said pair of arm members.

4. A ski brake comprising:

means forming a movable arm member movable between an operative position and an inoperative position;

means providing a moving force for moving said arm member from its inoperative position to its operative position;

means responsive to an applied force for holding said arm member in its inoperative position against said moving force;

a braking surface located on said arm member for engaging snow when said arm member is in its operative position;

resilient means separate from said moving force providing means for restraining said arm member in its operative position against a force tending to move said arm member from its operative position to its inoperative position, said resilient restraining means including means for forceably deforming said resilient restraining means as said arm member is moved to its operative position; and means for receiving said resilient restraining means when said arm member is moved to is operative position, and receiving means including means for relaxing said resilient restraining means when said arm member reaches its operative position.

5. The ski brake according to claim 4 wherein:

said resilient restraining means comprises a part of said holding means and said arm member; and said receiving means comprises a recess for slidably receiving said part.

6. A ski brake comprising:

means for forming a movable arm member movable between an operative position and an inoperative position;

means providing a moving force for moving said arm member from its inoperative position to its operative position;

means responsive to an applied force for holding said arm member in its inoperative position against said moving force;

a braking surface located on said arm member for engaging snow when said arm member is in its operative position;

means separate from said moving force providing means for restraining said arm member in its operative position against a force tending to move said arm member from its operative position to its inoperative position, said restraining means including means forming a recess into which said holding means moves when said arm member is moved to its operative position by said moving force; and a wall surface for guiding said holding means into said recess.

7. The ski brake of claim 6 wherein said wall surface is inclined to apply an increasing bending stress to said holding means as said arm member is moved from its inoperative position to its operative position.

* * * * *